US005079785A

United States Patent [19]

Garcia

[11] Patent Number: 5,079,785

[45] Date of Patent: * Jan. 14, 1992

[54] AUTOMATED INFLATABLE RING CUSHION DEVICE

[76] Inventor: Luis A. Garcia, 530 S.W. 42nd Ave., Apt. 13, Miami, Fla. 33134

[ * ] Notice: The portion of the term of this patent subsequent to Sep. 10, 2008 has been disclaimed.

[21] Appl. No.: 522,833

[22] Filed: Nov. 8, 1990

Related U.S. Application Data

[60] Continuation-in-part of Ser. No. 249,841, Sep. 27, 1988, abandoned, which is a division of Ser. No. 124,716, Oct. 26, 1987, Pat. No. 5,046,205, which is a continuation-in-part of Ser. No. 912,384, Sep. 26, 1986, abandoned.

[51] Int. Cl.[5] ..... A47C 20/00

[52] U.S. Cl. ..... 5/431; 5/453; 4/456

[58] Field of Search ..... 4/456; 5/449, 451, 453, 5/454, 431

[56] References Cited

U.S. PATENT DOCUMENTS

| | | | |
|---|---|---|---|
| 1,746,953 | 2/1930 | McCollum | 5/449 X |
| 2,119,687 | 6/1938 | Rexroad | 5/453 X |
| 2,246,205 | 6/1941 | Gray | 4/456 |
| 2,466,142 | 4/1949 | Yost | 4/456 |
| 2,750,600 | 6/1956 | MacDonald | 4/456 X |
| 2,785,419 | 3/1957 | Walker | 5/431 X |
| 3,008,153 | 11/1961 | Coulter | 4/456 X |
| 3,514,793 | 6/1970 | West | 4/456 |
| 3,628,197 | 12/1971 | Leventhal et al. | 4/456 X |
| 3,939,502 | 2/1976 | Miller | 4/456 |

FOREIGN PATENT DOCUMENTS

| | | | |
|---|---|---|---|
| 769792 | 3/1957 | United Kingdom | 4/453 |

*Primary Examiner*—Charles E. Phillips
*Attorney, Agent, or Firm*—Sanchelima & Assoc.

[57] ABSTRACT

This is an improvement in the way to inflate and deflate a doughnut-shape cushion device by doing it automatically. The electronic circuits of the device are activated by a user through a normally open momentary switch. This action turns on an electrical pump to start blowing air to the cushion and at the same time a solenold exhaust valve shuts off. This rubber cushion, attached to the underwear of a person, is inflated to a pressure pre-established in the microcomputer. The pressure sensing element monitors the changes in pressure inside the cushion. As long as the person wearing the cushion is seated, the computer maintains the solenoid exhaust valve closed. Once the person stands up, the pressure inside the cushion drops below the pre-established valve and then the microcomputer output voltage decreases to 0; the exhaust valve opens and consequently the cusion deflates. Later on, the cycle can be repeated by pressing the switch again to initiate the sequence of operations.

3 Claims, 4 Drawing Sheets

AUTOMATED INFLATABLE RING CUSHION DEVICE

OTHER RELATED APPLICATIONS

The present application is a continuation-in-part of U.S. patent application Ser. No. 249,841, filed on Sept. 27, 1988, now abandoned. Which is a division of U.S. patent application Ser. No. 124,716, filed on Oct. 26, 1987 (now U.S. Pat. No. 5,046,205 and is hereby incorporated by reference) and which is a continuation-in-part of U.S. patent application Ser. No. 912,384, filed on Sept. 26, 1986, now abandoned.

BACKGROUND OF THE INVENTION

Field of the Invention

The present invention relates to an improved way to automatically inflate and deflate a cushion device.

SUMMARY OF THE INVENTION

In the past, people suffering from hemorrhoids or other rectum disease, had to carry in their hands the suitable type of cushion to avoid pain in the injured area when they wanted to sit on a hard surface. This brought not only the uncomfortable situation of carrying an object, but also the cushion had to be exhibited in public. This causes an undesirable embarrassment when the attention id drawn to the cushion under the person's body. The present invention avoids all these inconveniences just described. The innovation of the invention already disclosed was conceived keeping in mind the same concepts of portability and concealment. On the other hand, the automatic control by means of a programmable microcomputer simplifies the operation by making the system self-governed once the starting switch is actuated. The operation of the system is inconspicuous to the eyes of an outside viewer. In accordance with these characteristics, the instant innovation will be described with reference to the accompanying drawings.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings, in which.

DETAILED DESCRIPTION OF THE PREFERRED EMBODIMENT

Figure 1:
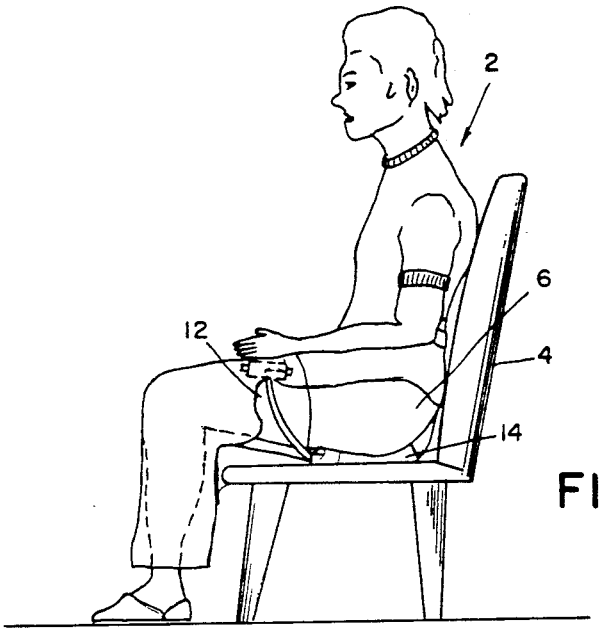
FIG. 1 represents an elevational view illustrating the instant invention.
Figure 2:
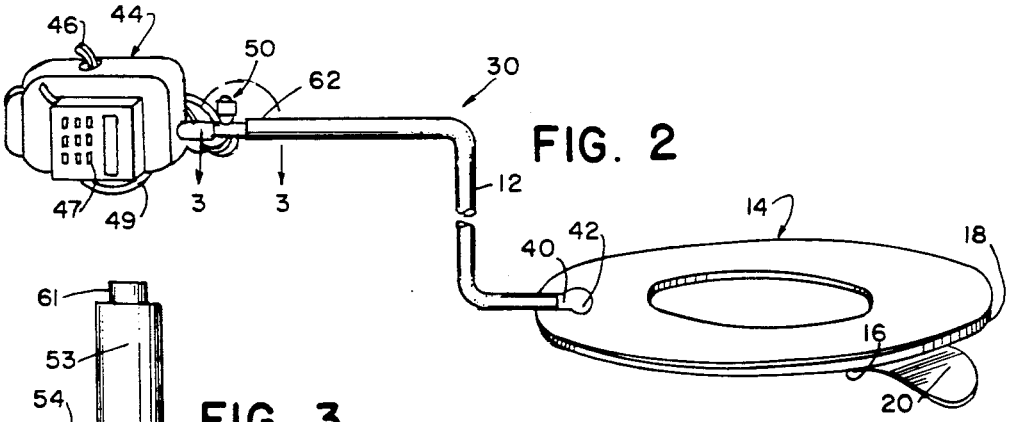
FIG. 2 shows a view of the system assembled.

Referring now to the drawings, where the present invention is generally referred to with numeral 30, it can be observed that FIG. 1 is a side elevational view of a user 2 seated on a chair 4 and using device mounted inside his garment. Actually, user 2 is seated over the inflated cushion stuck to his underwear 6, in the preferred embodiment. FIG. 2 is a view of the device designated by the numeral 30, which includes electrical direct current, miniature air pump 44 of the plunger or diaphragm type, or any other appropriate type. Pump 44 has metal ring 49 and output hose 56. The body and internal parts of said pump can be fabricated from plastic, rubber and aluminum stocks, or from any other material. Normally, open momentary switch 46 turns on said pump 44. This normally open momentary switch is an electro-mechanical device that completes the path of the current in a circuit, as long as an actuating force is applied, returning to its open position when the actuating force is removed. Electric power battery 48 feeds the starting circuit, the latch circuit and the pressure sensor circuit. Microcomputer 47 is used to control the operation of the circuits. Small air control T coupler 50 is a hollow body having three nipples containing inside each one of the them the following components: a non-return inlet valve 58; an exhaust electrical valve 61; and a pressure sensing element 57. T coupler 50 can be made of any appropriate light weight material. Thin flexible hose 12 of suitable length connects nipple 60 to nipple 40. Inflatable-deflatable tubular cushion 14 has substantially a doughnut shape. Cushion 14 occupies, in the exhausted condition, an area not bigger than the buttocks area of the average person. The diameter of the entire hole of said cushion is limited by the average of the normal distance range between both ischium epiphysis in the hipbone of the human skeleton. Those characteristics make cushion 14 small enough to be carried attached to the underwear. Small metal ring 49 is anchored to the bottom of the body of pump 44. Said metal ring is used to hang the combination of air pump 44, microcomputer 47, T coupler 50, and external battery 48 from the appropriate place inside the garments of the wearer. For the sake of clarity, the drawings do not show a removable cloth sheath 15 covering tangentially the entire outside surface of cushion 14 as partially drawn in FIG. 2. Sheath 15 is used as a protector and mainly to limit the amount of air pumped to cushion 14. Sheath 15 could be made of nylon cloth or the like similarly used in life jackets. In FIG. 2, one end of the flexible hose 12 is connected to the nipple 42 in the tubular ring 14 by means of the independent nipple 40. The other end 62 of the flexible hose 12 is connected to the short nipple 60 in the T coupler 50. The output hose 56 of the pump 44 is connected to the short nipple 52 in said T coupler 50, so the air is delivered to the cushion 14 through the non-return inlet valve 58 inside said nipple 52. Finally, one side of the disposable double faced adhesive tape 18 is stuck to the bottom surface 19 of the rubber support 16 of the ring 14.

Figure 3:
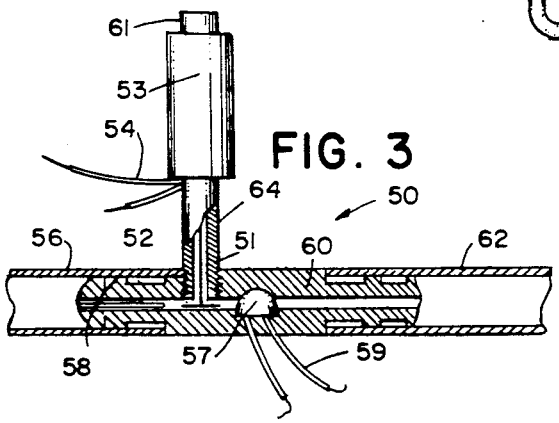
FIG. 3 illustrates a cross-sectional view taken in the zone indicated by the line 3—3 of FIG. 2.

FIG. 3 is a view in cross section of air control T coupler 40. This coupler 50 has nipples 60, 52 and 64.

Short nipple 60 with external circumferential grooves cut at its free end is designed to help retain tip 62 of hose 12. Nipple 60 has a hole drilled at its mid-point and in a plane parallel to the longitudinal axis. This hole contains the pressure sensing element 57 mounted hermetically. This sensor 57 could be a solid-state strain gauge of the piezo-resistive type or any other appropriate type. Short nipple 52 with external grooves is designed to retain the free tip of output hose 56 in pump 44. Nipple 52 contains inside non-return inlet valve 58. Valve 58 is similar to the valve used in the sphygmomonometer, to control the air in one direction only. Large nipple 64 with threads outside its body to screw the electrical valve 61 is designed to remove the air from the ring 14. Said valve 61 could be of the solenoid type or any other appropriate type.

Figure 4:
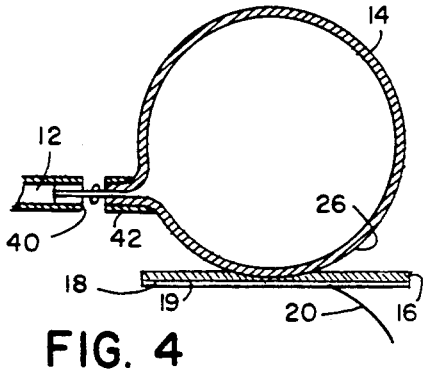
FIG. 4 is a partial view in cross-section illustrating the right-hand portion of FIG. 2 in the inflated mode.
Figure 5:
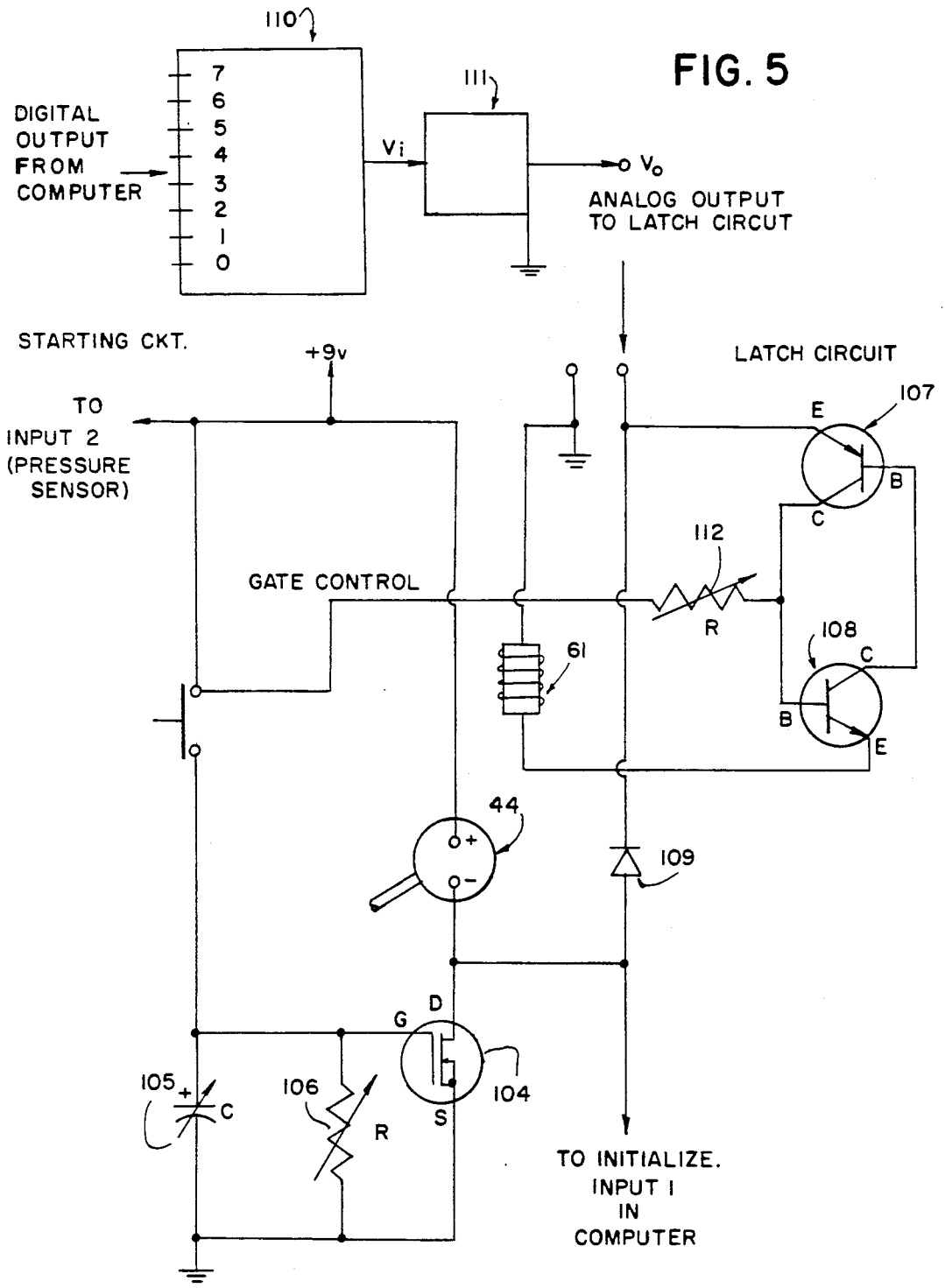
FIG. 5 is the electronic drawing corresponding to the switching circuit composed of the starting circuit and the latch circuit. The microcomputer output is included as a block diagram for the related circuits.

FIG. 4 is a view in cross section of the tubular cushion 14. Inflatable tubular ring 14 is made out of a resilient natural or synthetic rubber or another suitable material. Tubular ring 14 is similar to the type used for automobile tire inner tubes. Ring 14 includes rubber nipple 42. Non-inflatable washer shape, stiff rubber flat support 16 has the same peripheral contour and dimensions of ring 14 in the deflated condition. A central circumferential strip, about 1/5 the area of a side of said support 16, is vulcanized or molded on one side of the ring 14, surrounding the circular edge of the center hole of the cushion 14. The surface of the bottom part 19 of the flat support 16 will be rough as to allow it to stick securely disposable double faced adhesive tape 18. The reason to use the flat support 16 is to make independent the movement of the ring 14. If ring 14 is attached directly to the underwear, it would have the tendency to unfasten while it is in the process of inflating it. Nipple 40 with external grooves is designed to interconnect nipple 42 of ring 14 to hose 12.

Figure 6:
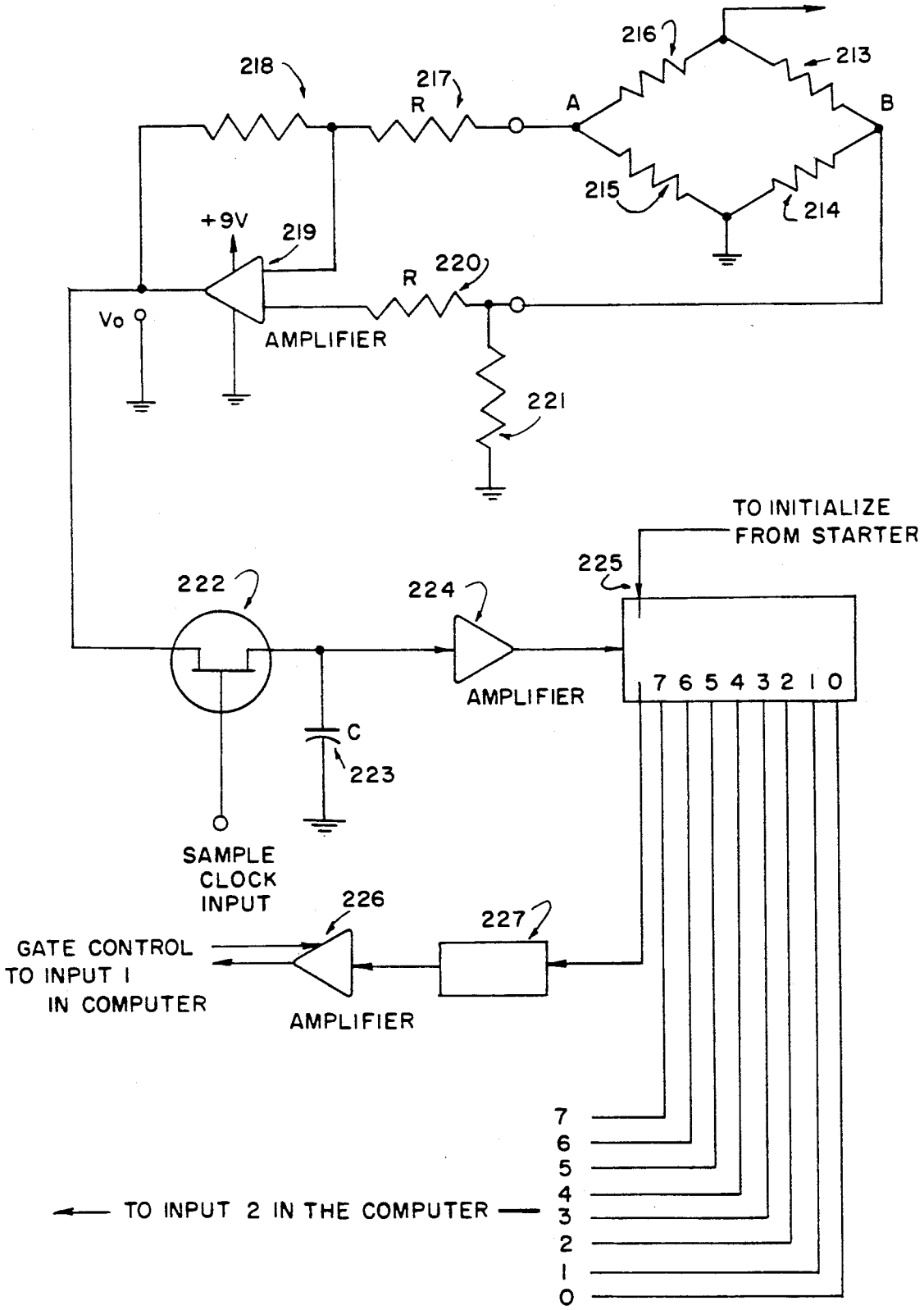
FIG. 6 is the electronic diagram corresponding to the pressure sensor circuit and the input 1 and input 2 circuits to the microcomputer.

FIG. 6 is a representation of the electronic diagram of the wiring of the switching circuit which includes starting and latch circuits. The block diagrams of the microcomputer output circuit are included as reference only. The switching circuit comprises the following parts: normally open momentary switch 46; the solenoid electric valve 61; the midget electric pump 44; the field effect power transistor 104 of the metal oxide semiconductor type (power Mosfet); variable capacitor 105; the potentiometers 106 and 112; transistor 107 of semiconductor PNP type; transistor 108 of the semiconductor NPN type; and semiconductor diode rectifier 109. Numeral 110 and 111 represent the digital-to-analog converter and the low pass filter integrated circuits.

Figure 7:
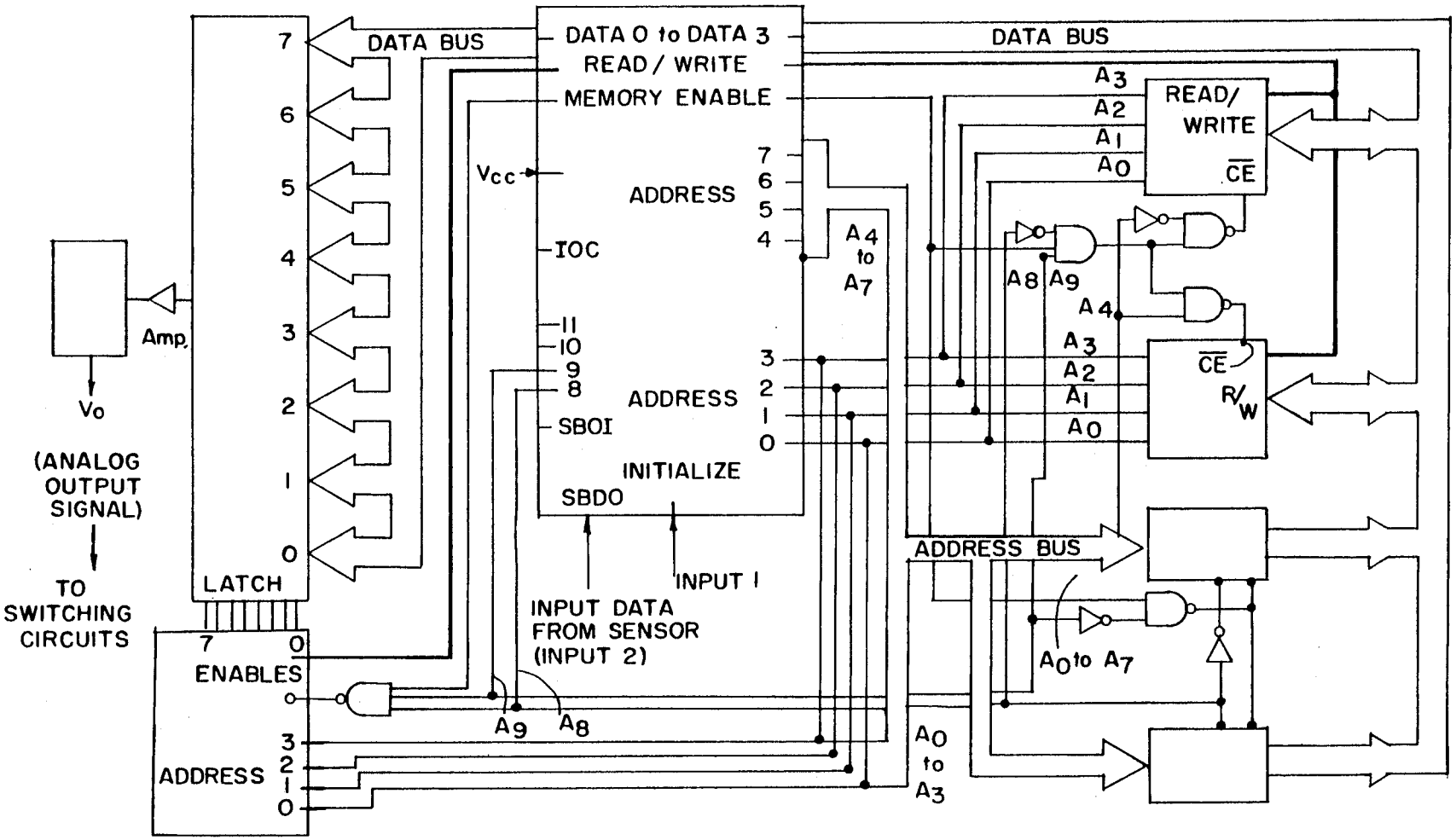
FIG. 7 is the electronic diagram corresponding to the internal organization of the microcomputer.

FIG. 7 is an electronic diagram of the wiring of the pressure sensor circuit and the block diagram corresponding to the input 1 and the input 2 (data/address lines) to microcomputer 47. The circuit includes the following components: resistors 213, 214, 215, and 216, forming the precalibrated Wheatsone bridge; the limiting resistors 217, 218, 220 and 221; differential amplifier 219 (usually the above mentioned components form a micro-package unit to consistute the complete pressure sensor); field effect transistor 222 (FET); holding capacitor 223; integrated circuit amplifiers 224 and 226; analog-to-digital converter 225; and flip-flop circuit 227 to the input 1 in the microcomputer.

FIG. 8 corresponds to the internal organization of the microprocessor chip inside the computer and its relation with the rest of the circuits. Chip 47 typically includes the following components: control unit 228 for 4-bit microprocessor; random-access memory (RAM) 229 and 234; digital inverters 238: 236: 238 and 245; digital logic and gate 231; digital logic NAND gates 232, 233, 237 and 240; programmable read only memory 235 and 239 (it is abbreviated PROM); 4-to-16 decoder integrated circuit 241; and amplifier integrated circuit 243.

For men, cushion 14 can be attached to the inside or outside of either boxer or the athletic type of underwear, depending on the comfort desired.

For women, cushion 14 can be worn inside panties, although in many instances it can be used on the outside of the panties when wearing slacks, long shorts, etc.

To set the device 30 in place, peel the outer liner 20 covering the adhesive tape 18 and stick the flat, exhausted cushion 14 to the underwear so as to encircle the anal zone. The combination of air pump 44, microcomputer 47, battery 48, and T coupler 50 mechanically connected to the flexible hose 12 is routed internally through the garments. Finally, the combination is hung with a safety pin, by way of ring 49, to the right or left front pockets in the men's pants, just between the pocket cloth and the pant cloth.

For women, the combination can be hung in a convenient place inside the skirt within hand reach. Just before sitting down, a user presses momentary switch 46 to turn on pump 44 to inflate cushion 14 until a specific pressure is reached. Then, he or she is ready to sit. Pump 44 stops and solenoid valve is held closed by the computer output voltage.

Referring now to FIGS. 6, 7, and 8, the operation of device 30 will be explained. When normally open momentary switch 46 is pressed and released MOSFET transistor 204 of the starting circuit (which is actually an off-after-delay circuit) will start to conduct, causing the following: pump 44 is turned on and starts to pump air into cushion 14; at the same time, the latch circuit is activated, holding the solenoid valve 61 closed; a small part of the current produced in the starting circuit goes to the input 1 of microcomputer 47 to initialize its operation. When microcomputer 47 turns on, it starts to analyze the variation in pressures monitored by pressure sensor 57. The conduction time for MOSFET transistor 104 depends on the time constant of its circuit. This time constant depends on the values of variable capacitor 105 and potentiometer 106. The operating time of the circuit could be varied from seconds to minutes. After the delay time of the starting circuit has elapsed, MOSFET transistor 104 stops conducting and pump 44 turns off. At this point, solenoid valve 61 is held closed because said valve is controlled now by the computer output voltage, independently from the initial starting voltage which is zero at this moment. If the pressure inside cushion 14 is maintained to a pre-established value, affected by the weight of the user, microcomputer 47 output voltage will hold solenoid valve 61 closed. When the pressure inside cushion 14 decreases, because the user stands up, then the computer output voltage drops to zero and solenoid valve 61 will open, deflating cushion ring 14.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

I claim:

1. An inflatable doughnut-shaped cushion, comprising:

A a nipple member connected to said cushion;

B a flexible conduit member having two ends and one of said ends being connected to said nipple member;

C a hollow T-coupler having first, second and third tubular nipple means interconnected with each other and said first nipple means being connected to the other end of said flexible conduit member, said second tubular nipple means houses a non-return inlet valve and said third tubular nipple means houses an electrically actuated solenoid valve member that releasably connects said third tubular nipple means with said first and second nipple tubular means;

D an air pump member having an outlet port connected to said second tubular nipple means and said air pump member further including a metal ring attached thereto for anchoring said pump to the inner portion of a user's garment;

E micro-computer means for driving said electrically actuated solenoid valve member and said air pump member, and said microcomputer means is so designed and constructed to operate said air pump member and said electrically actuated solenoid valve member in a predetermined manner; and F circuit means for selectively starting said microcomputer means and air pump member and further including a momentary switch member, a pressure sensing means for sensing the pressure inside said cushion, said sensor being connected to said microcomputer means.

2. The cushion set forth in claim 1 further including a safety pin mounted in a concealed area of a user's garment and adapted to secure said pump in place via said ring when said pump is positioned in said garment.

3. The cushion set forth in claim 1 wherein said air pump member, microcomputer means and circuit means are rigidly mounted to each other making one piece and being mounted in a concealed area of the user's garment.

* * * * *